United States Patent [19]

Lautenschläger, Jr.

[11] Patent Number: 4,771,508

[45] Date of Patent: Sep. 20, 1988

[54] ARRANGEMENT AND SUPPORT OF PIVOTS IN A FOUR-JOINT CABINET HINGE

[75] Inventor: Karl Lautenschläger, Jr., Reinheim, Fed. Rep. of Germany

[73] Assignee: Karl Lautenschlager GmbH & Co. KG, Reinheim, Fed. Rep. of Germany

[21] Appl. No.: 23,263

[22] Filed: Mar. 9, 1987

[30] Foreign Application Priority Data

Mar. 25, 1986 [DE] Fed. Rep. of Germany ..... 3610102

[51] Int. Cl.[4] ..... E05D 15/32; E05D 5/10

[52] U.S. Cl. ..... 16/370; 16/386

[58] Field of Search ..... 16/288, 302, 370, 382, 16/386, DIG. 43

[56] References Cited

U.S. PATENT DOCUMENTS

| | | | |
|---|---|---|---|
| 4,499,631 | 2/1985 | Lautenschlager | 16/370 |
| 4,551,883 | 11/1985 | Rock et al. | 16/386 X |
| 4,615,074 | 10/1986 | Lautenschlager, Jr. et al. | 16/370 |
| 4,641,396 | 2/1987 | Rock et al. | 16/370 |

*Primary Examiner*—Fred A. Silverberg

[57] ABSTRACT

A four-joint cabinet door hinge, especially for opening angles of more than 105°, in which the door-related hinge part is a stamped and drawn cup of thin sheet metal. The pivot pin at the cup end of the inner link is located in a recess of the wall of the cup and is held in the recess by a tongue formed from material of the wall.

9 Claims, 3 Drawing Sheets

Fig. 4
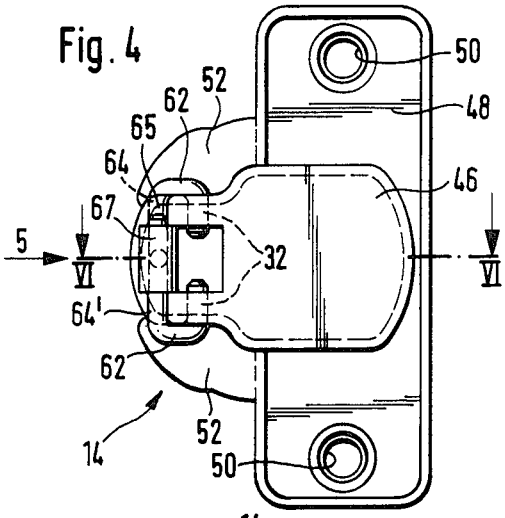
Fig. 5
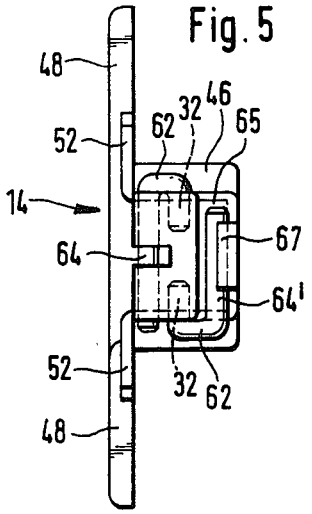
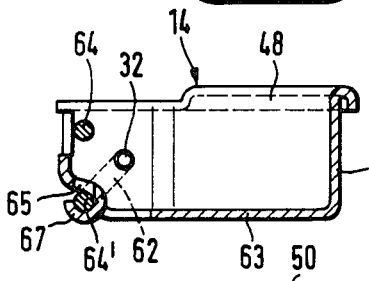
Fig. 6
Fig. 7
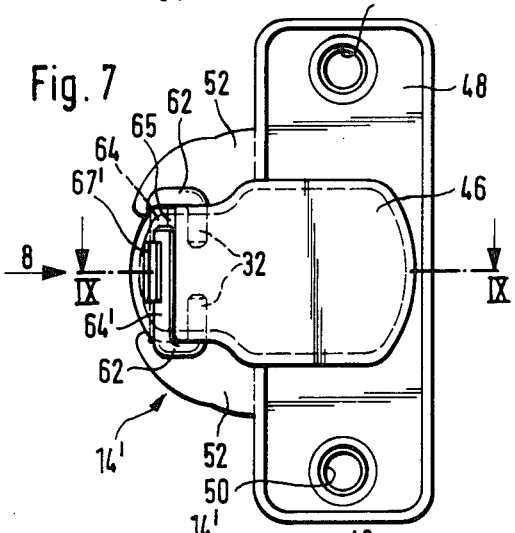
Fig. 8
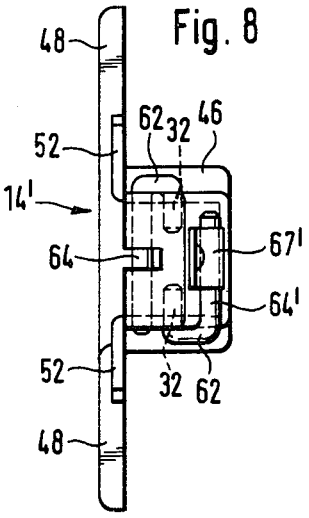
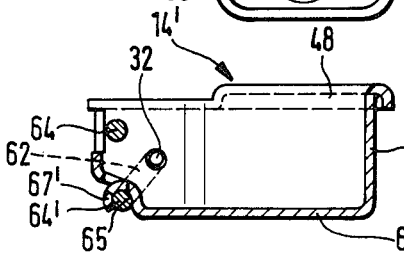
Fig. 9

Fig. 10
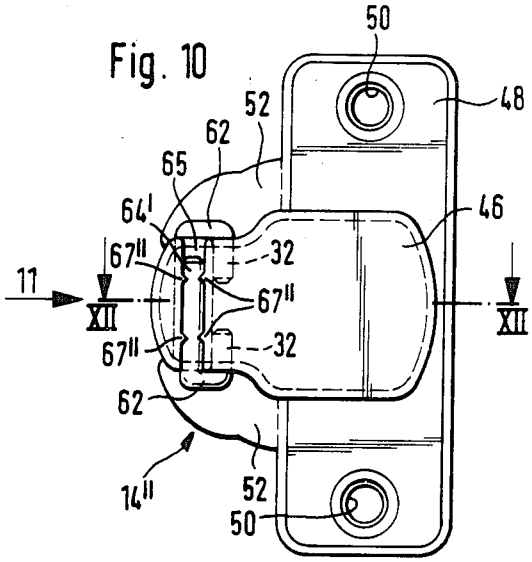
Fig. 11
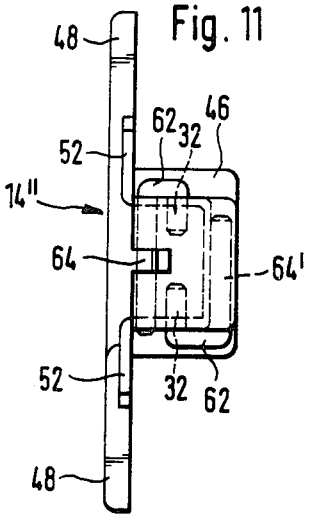
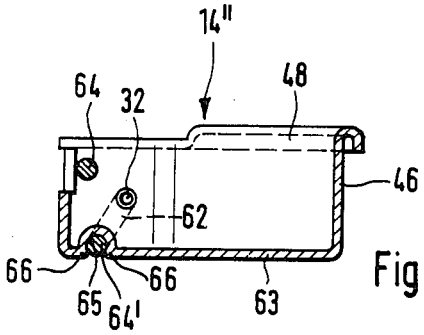
Fig. 12

ARRANGEMENT AND SUPPORT OF PIVOTS IN A FOUR-JOINT CABINET HINGE

BACKGROUND OF THE INVENTION

The invention relates to a four-joint cabinet door hinge, especially for door opening angles of more than 105°, which has as its carcase-related part a supporting arm that can be fastened adjustably to a wall of a cabinet carcase and, as the door-related part, a cup stamped and drawn from thin sheet steel which can be sunk and fastened in a recess in the back of the door, these parts being coupled together by two links whose ends are attached to pivots set in bores in the supporting arm and in the cup. The link which is the outer link when the hinge is open has pivot bores in lugs formed on its end within the cup, into each of which a short pivot projecting from the adjacent wall of the cup enters such that between the confronting ends of the pivots a free passage remains for the inner hinge link. The short, projecting pivots merge integrally at their ends outside the walls with a crook which merges at its other end with an additional, longer, pin-like limb bent back parallel to the pivot. The parallel limb of one of the pivots at the same time constitutes the cup-end pivot for the inner hinge link, while the parallel, pin-like limb of the other pivot is held in a transverse recess which is formed in the wall of the cup.

The invention is addressed to the problem of improving such hinges with regard to secure mounting and rapid assembly of the pin-like limb held in the transverse recess in the cup, and with regard to the simplified manufacture of the cup.

SUMMARY OF THE INVENTION

Setting out from a hinge of the kind described above, this problem is solved according to the invention in that the transverse recess is made by embossing the material of the bottom of the cup from its outside into its interior, and has a depth, with respect to the outer surface of the bottom, which is approximately equal to the diameter of the transverse pin-like limb, and that out of the material of the cup at least one holding means is formed which overlaps at least a section of the pin-like limb lying in the transverse recess.

The transverse recess is best provided in the area of transition from the bottom of the cup to its circumferential wall such that it is formed in part from the indented bottom and in part from the indented circumferential wall, and the holding means is a tongue cut from the material of the cup adjacent the transverse recess, whose free end is bent to a position overreaching the pin-like limb. This tongue, which merges with the cup along only one margin, can be made in such a location that, after the pin-like limb is installed in the recess, it will engage this limb with a resilient bias.

It is recommendable then to bend the cut tongue in its area overlapping the pin-like limb to the radius of the latter, such that its surface facing the pin-like limb will conform to the latter.

In a preferred embodiment of the invention, the tongue is cut from the area of the bottom of the cup adjoining the transverse recess such that its free end will point away from the transverse recess, and then will be bent back over the recess.

Alternatively, the tongue can also be cut from the material of the transverse recess such that its free end will point toward the circumferential wall of the cup, and it will then be bent downward toward the bottom by its free end, around the pin-like limb.

In an additional embodiment, the transverse recess can also be embossed into the interior of the cup from the bottom only, in which case the recess passes through the circumferential wall of the cup only at its extremities.

The securing of the pin-like limb in the recess can then be achieved by making the holding means for gripping the limb in the form of bosses formed from inside the cup from the material of the walls of the recess and projecting into the recess.

BRIEF DESCRIPTION OF THE DRAWING

The invention will be further explained in the description that follows of several embodiments, in conjunction with the drawing, wherein:

FIG. 4 is a bottom view of the cup of a first embodiment of the hinge according to the invention, FIG. 5 is a view of the cup seen in the direction of the arrow 5 in FIG. 4, FIG. 6 is a cross-sectional view seen in the direction of the arrows VI—VI in FIG. 4, FIG. 7 is a bottom view of the cup of a second embodiment of a hinge according to the invention, FIG. 8 is a view of the cup seen in the direction of the arrow 8 in FIG. 7, FIG. 9 is a cross sectional view seen in the direction of the arrows IX—IX in FIG. 7, FIG. 10 is a bottom view of the cup of a third embodiment of a hinge according to the invention, FIG. 11 is a view of the cup seen in the direction of the arrow 11 in FIG. 10, and FIG. 12 is a cross-sectional view of the cup, seen in the direction of the arrows XII—XII in FIG. 10.

DETAILED DESCRIPTION OF PREFERRED EMBODIMENTS

Figure 1:
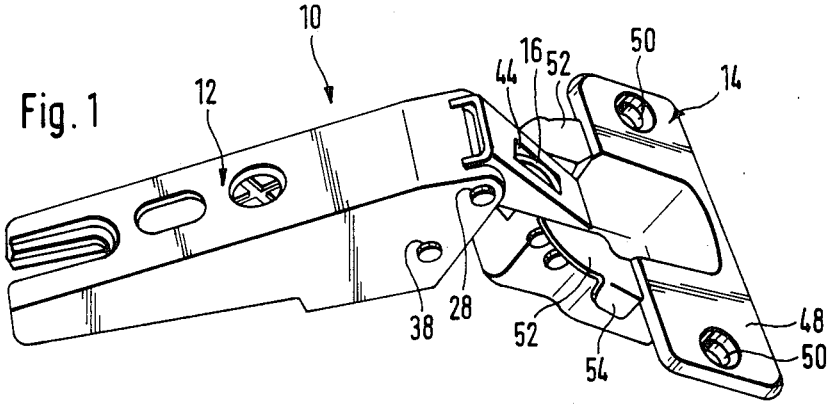
FIG. 1 is a perspective view of a four-joint cabinet door hinge with an enlarged door opening angle, in the open position.
Figure 2:
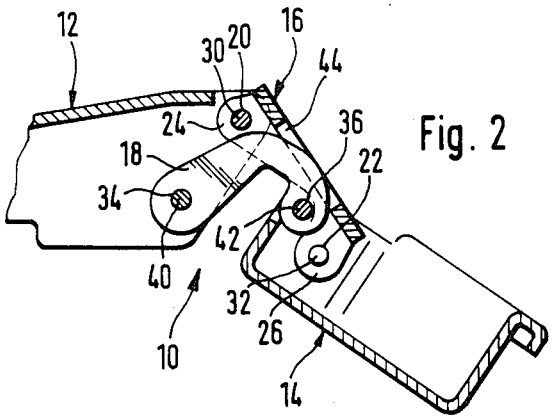
FIG. 2 is a longitudinal central section through the cup, the link, and the end adjacent the door of the supporting arm of the hinge shown in FIG. 1, again in the open position.
Figure 3:
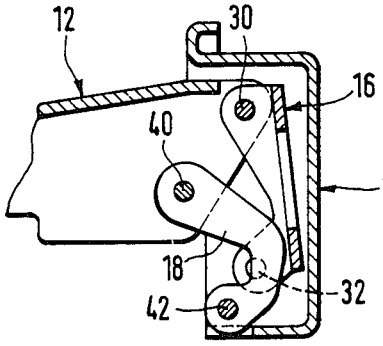
FIG. 3 is a cross-sectional view corresponding to the cross section in FIG. 2, of the hinge in the closed position.

The hinge according to the invention, shown in FIG. 1 and identified as a whole by the number 10, is a so-called four-joint hinge which can open to an angle of, say, 130° (FIGS. 1 and 2). The hinge is composed of a supporting arm 12 of channel-shaped cross section which can be fastened adjustably on a mounting plate (not shown) preinstalled on the wall of a cabinet, and of a cup 14 which can be sunk and fastened in a mortise in the back of a door. These components are coupled to one another by two hinge links 16 and 18 pivoted at one end on the supporting arm 12 and at the other end in the cup 14, such that the cup—and thus a door fastened to it—can be swung into the closed position shown in FIG. 3. The outer hinge link 16 which is visible in the open position is in the form of a rectangular strip of sheet metal on whose longitudinal margins lug-like sections bent at right angles are formed adjacent its ends, which with the aligned bores 20 and 22 constitute pivot ears 24 and 26 at the supporting arm end and the cup end, respectively. By means of a pivot 30 held in aligned bores 28 in the flanges of the supporting arm and passing through the bores 20 in the hinge link 16, the hinge link 16 is pivoted on the supporting arm 12, while the pivoting of its other end inside of the cup 14 is provided by two short pivots 32 projecting from the inside surfaces of the cup and engaged each in one of the bores 22 in the hinge link 16; thus, between the confronting ends of the pivots 32 there remains a space through which the inner hinge link 18, of appropriately narrow dimensions, can pass as the cup 14 approaches the closed position (FIG. 3). The inner hinge link 18, which is of a bent shape in side elevation, has bores 34 and 36 at its ends, the bore 34 at the supporting arm end containing a pivot 40 held in aligned bores in the flanges of the supporting arm 12, and the bore 36 at the cup end containing a pivot 42 held in aligned bores (not shown) in the wall of the cup 14. The four-joint hinge described up to this point is known in itself, and it can be seen that the opening angle, which is larger than it is in the normal four-joint hinges designed to be opened to 90° or, in any case, 105°, is made possible by the fact that the cup end of the inner hinge link 18 is able to pass between the short pivots 32 projecting from the wall of cup 14 as it approaches the closed position; this would not be possible if, instead of the two pivots 32, a single pivot running all the way through were to be provided. In this connection, however, the opening 44 is to be noted, which can be seen in the outer link 16 and which is stamped approximately in the center of the back of the latter, and into which the middle, bent section of the inner hinge link 18 can enter, so that the latter can have the curved shape desired for the strength of its central portion (see also DE-OS No. 31 08 224 in this connection).

The cup 14 of the four-joint hinge 10 according to the invention is stamped and drawn from sheet steel, thereby resulting in a considerable cost saving in comparison to the cups of cast metal, mainly die-cast zinc, which heretofore have been used for this application almost exclusively. While the mounting of through pins held at both ends in bores in the wall of the cup in such cups formed from sheet steel presents no difficulty, so that they are widely used in ordinary four-joint hinges, such difficulties do exist in regard to a sufficiently strong fastening of the short, projecting pivots 32 in the thin sheet metal wall. In the case of pressure-cast cups the wall thickness can be made sufficiently great in the area of the bore to accommodate these pivots 32, so that they can be pressed into the bores and can be adequately retained therein. In the case of cups stamped from sheet steel, however, fastening the pivots exclusively by means of press-fitting is impossible on account of their insufficient wall thickness. The addition of separate fasteners for the pivots 32 or their direct fastening in the cup by welding would be too complicated and would nullify the desired cost saving over cast metal cups. It is for this reason that several possibilities for the construction of cups stamped from sheet metal have been developed, in which the short pivots 32 can be held sufficiently strongly on the one hand and can be installed in the cup without special difficulty on the other, and three different embodiments thereof are to be described hereinbelow.

In the case of the cup 14 stamped from sheet steel, which is shown in FIGS. 4 to 6, one possibility is presented for the mounting of the two short pivots 32 holding the hinge link 16 at the cup end, which is basically similar to the above-mentioned known configuration and mounting of these pivots, but at the same time avoids its disadvantages. The cup 14 has an elongated, bathtub- or trough-shaped portion 46, in which the hinge links 16 and 18 are pivoted, and which is sunk and fastened in the corresponding mortise in the door. Adjoining the upper margin of part 46 is a marginal flange projecting at right angles, which is in the form of a hollow mounting flange placed on the inside of the door and having countersunk holes 50 for the mounting screws which can be driven into the material outside of the mortise in the back of the door, while the remaining portions 52 serve only to cover up the lateral portions of the mortise (of circular plan) remaining unfilled alongside the bathtub- or trough-shaped portion 46, and they are shaped accordingly. Guiding lugs 54 (FIG. 1) cut on portions 52 on opposite sides and bent back at right angles toward the bathtub- or trough-shaped part 46 center the cup 14 against lateral shifting in the mortise cut in the door.

The pivot 32 of spring steel wire seen at the top in FIGS. 4 and 5 is bent at right angles, in the manner already acknowledged as known, from one end of a crook 62, from whose other end a longer, pin-like section 64 is bent at a distance from and parallel to the pivot 32. The section 64 is made so long that it can be passed through aligned bores in the two opposite side walls of the trough-like or bathtub-like portion 46, and at the same time can be fixed in those bores, by press-fitting, for example, while the crook 62 lies, in the manner seen in FIGS. 4 and 5, on the outer surface of the side wall of the trough-like part 46. At the same time the pin-like section 64 passing through the trough-like part 46 is used simultaneously, in the manner known in the state of the art, as a pivot for the cup-end pivoting of the inner link 18, i.e., it serves the purpose of the pivot described as a separate pivot 42 in connection with FIGS. 2 and 3.

The short pivot 32 seen at the bottom in FIGS. 4 and 5 is also bent at right angles from a crook 62 at whose other end, again, a longer, pin-like section 64' is bent at a distance from and parallel to the pivot 32, but in this case it can be shorter than the pin-like section 64. That is to say, the section 64' is not passed through bores in the side walls of the trough-like portion 46, but lies in an indentation 65 running transversely of the side walls of the trough-like portion 46, in the circumferential wall of the cup adjacent to the edge of the door, in the area of transition between the circumferential wall and the bottom, while a tongue 67 is cut from the area of the bottom 63 of the cup adjoining the indentation, and its free end, which at first is pointing away from the indentation 65, is bent back over the indentation and thus wraps around the pin-like section 64' and holds it in the indentation 65.

FIGS. 7 to 9 show a cup 14' which is similar to the cup described in connection with FIGS. 4 to 6, and differs from cup 14 only in the configuration of the tongue 67' securing pin section 64' in the indentation 65. This tongue 67', in the case of cup 14', is not cut from the material of the bottom 63 but from the material of the transverse indentation 65, with its free end pointing toward the circumferential wall of the cup. To secure the pin section 64 in the indentation 65, the free end of tongue 67' is then bent downwardly around the pin section. Since the cup 14' is otherwise the same as cup 14, it is sufficient to refer, with regard to its construction, to the foregoing description of FIGS. 4 to 6, since the same reference numbers are used for identical parts of the two cups 14 and 14'.

Lastly, in FIGS. 10 to 12 there is shown another cup 14'' which again is largely the same as the cups 14 and 14', while once again the same reference numbers are associated with equal parts. Thus it is again sufficient to describe hereinafter the differences from the previously described cups 14 and 14'.

It can be seen especially in FIG. 12 that the transverse indentation 65 in the case of cup 14'' is formed exclusively from the bottom 63 by embossing the latter into the interior of the cup, the opposite ends of the indentation opening in the lateral part of the circumferential wall. The inside of the indentation 65 is rounded to correspond to the diameter of pin section 64', and its width and depth are such that the pin section 64' just fits into the indentation without projecting beyond the outer surface of the bottom 63.

Bosses 66 struck from inside the cup into the lateral walls of the indentation form holding means for locking the pin section 64' within the indentation in the required manner.

I claim:

1. A four-joint cabinet door hinge, especially for doors to be opened by more than 105°, comprising:

a supporting arm to be adjustably fastened to a carcase of a furniture cabinet;

a cup stamped and drawn from relatively thin sheet metal, to be sunk and fastened in a recess in a door of the cabinet, and having wall means including a bottom wall and a circumferential wall merging with the bottom wall;

a first link having a first end with pivot bores within the cup and a second end pivotally connected to the supporting arm;

a second link having a first end with pivot bores within the cup and a second end pivotally connected to the supporting arm;

first and second pivots projecting from said wall means into said cup towards each other and leaving a gap therebetween, and supporting in said pivot bores of said first link; each pivot forming part of a crook located outside said cup and of a pin extending parallel to the respective pivot, within the cup; one of said pins extending over the width of the cup and having ends supported in said pivot bores of said second link and forming the pivot thereof; the other pin being held in a transverse recess in said wall means outside the cup; said recess being a deformation of said wall means into the cup, said recess having a depth corresponding to the thickness of the other pin;

and a holding portion for said other pin in said recess and forming part of said wall means.

2. A hinge according to claim 1, wherein said recess is formed in part by said bottom wall and in part by said circumferential wall; said holding portion being a tongue formed from material of said wall means adjacent said transverse recess.

3. A hinge according to claim 3, wherein said tongue is bent to conform to the other pin.

4. A hinge according to claim 3, wherein said tongue is formed from said bottom wall and has a free end which points away from said transverse recess and is bent back over said recess.

5. A hinge according to claim 2, wherein said tongue is formed from the wall means forming said recess and has a free end which points towards the circumferential wall and which is bent downwardly around the other pin.

6. A hinger according to claim 2, wherein said tongue is formed from said bottom wall and has a free end which points away from said transverse recess and is bent back over said recess.

7. A hinge according to claim 2, wherein said tongue is formed from the wall means forming said recess and has a free end which points towards the circumferential wall and which is bent downwardly around the other pin.

8. A hinge according to claim 1, wherein said recess is deformed from said bottom wall into the cup and is open in the circumferential wall at opposite ends of the recess only.

9. A hinge according to claim 8, wherein said holding portion is at least one boss of the wall forming the recess and extending into the recess.

* * * * *